US007618335B2

(12) United States Patent
Brown et al.

(10) Patent No.: US 7,618,335 B2
(45) Date of Patent: Nov. 17, 2009

(54) LACROSSE HEADS

(75) Inventors: Ashely James Brown, Portsmouth, NH (US); Kyle Larry Lamson, Chelmsford, MA (US); Alexander Reynolds, Wayland, MA (US)

(73) Assignee: Warrior Sports, Inc., Warren, MI (US)

( * ) Notice: Subject to any disclaimer, the term of this patent is extended or adjusted under 35 U.S.C. 154(b) by 344 days.

(21) Appl. No.: 11/737,198

(22) Filed: Apr. 19, 2007

(65) Prior Publication Data

US 2007/0249436 A1 Oct. 25, 2007

Related U.S. Application Data

(60) Provisional application No. 60/793,492, filed on Apr. 19, 2006.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | |
|---|---|---|---|
| 3,507,495 | A | 4/1970 | Tucker et al. |
| 3,702,702 | A | 11/1972 | Hoult |
| 3,822,062 | A | 7/1974 | Tucker et al. |
| 4,034,984 | A | 7/1977 | Crawford et al. |
| 4,097,046 | A | 6/1978 | Friant |
| 4,128,239 | A | 12/1978 | Grenadier |
| 4,138,111 | A | 2/1979 | Rule |
| 4,206,918 | A | 6/1980 | Lewis, Jr. |
| 4,358,117 | A | 11/1982 | Deutsch |
| 5,048,843 | A | 9/1991 | Dorfi et al. |
| 5,082,290 | A | 1/1992 | Tucker et al. |
| 5,174,580 | A | 12/1992 | Pratt |
| 5,178,397 | A | 1/1993 | Brine, Jr. |
| 5,269,532 | A | 12/1993 | Tucker et al. |
| 5,566,947 | A | 10/1996 | Tucker et al. |
| 5,674,140 | A | 10/1997 | Tucker et al. |
| 5,935,026 | A | 8/1999 | Dill et al. |
| 5,957,791 | A | 9/1999 | Nichols et al. |
| 6,066,056 | A | 5/2000 | Morrow |
| 6,852,047 | B2 | 2/2005 | Tucker, Sr. |
| 6,916,259 | B2 | 7/2005 | Kohler et al. |

(Continued)

FOREIGN PATENT DOCUMENTS

| | | |
|---|---|---|
| CA | 342045 | 6/1934 |

(Continued)

*Primary Examiner*—Gene Kim
*Assistant Examiner*—M Chambers
(74) *Attorney, Agent, or Firm*—Werner Norcross & Judd LLP

(57) ABSTRACT

A lacrosse head frame includes a first frame portion comprising a top portion and two side walls, and a second frame portion, at least a portion of the second frame portion is moveable relative to the first frame. A lacrosse head frame includes a first frame portion comprising a proximal end, and a second frame portion having a distal end and a proximal end, wherein the distal end extends from, or is connected to, the first frame, and a spring, wherein the proximal end of the second frame is coupled to the proximal end of the first frame via the spring.

15 Claims, 2 Drawing Sheets

U.S. PATENT DOCUMENTS

| | | | | |
|---|---|---|---|---|
| 7,044,868 | B2 * | 5/2006 | Brine et al. | 473/513 |
| 7,094,167 | B2 * | 8/2006 | Tucker, Sr. | 473/513 |
| 7,131,919 | B2 | 11/2006 | Kohler et al. | |
| 7,238,128 | B1 * | 7/2007 | Filice et al. | 473/513 |
| 7,282,000 | B2 * | 10/2007 | Brine et al. | 473/513 |
| 2005/0075200 | A1 * | 4/2005 | Brine et al. | 473/513 |
| 2005/0101420 | A1 * | 5/2005 | Tucker | 473/513 |

FOREIGN PATENT DOCUMENTS

| | | |
|---|---|---|
| GB | 424742 | 2/1935 |
| GB | 1589596 | 5/1977 |
| WO | 03002211 A2 | 1/2003 |

* cited by examiner

LACROSSE HEADS

CROSS REFERENCE TO RELATED APPLICATION

The present invention claims priority from U.S. Provisional Patent Application Ser. No. 60/793,492, filed Apr. 19, 2006, and entitled "Lacrosse Heads."

FIELD OF INVENTION

This invention relates to lacrosse equipment, and more specifically, to lacrosse heads.

BACKGROUND

A lacrosse head generally includes a lacrosse head frame and a net connected to a perimeter of the head frame to thereby form a pocket into which the ball is received and from which the ball is thrown.

Sometimes, after a player catches a ball with the lacrosse head, there is a tendency that the ball may bounce out of, or fall out from, the pocket. As such, it is desirable to provide an improved lacrosse head that will assist a player in retaining a ball in the pocket as the lacrosse head catches the ball, or after the lacrosse head catches the ball.

Also, the portion of existing lacrosse head frames to which the net is connected is generally relatively rigid. As a result, when existing lacrosse head frames are used to catch a ball, the vibration resulted from the ball contacting the net may be transmitted readily by the head frame to a handle. This, in turn, may cause discomfort felt by the player.

Another problem with existing lacrosse heads is that they may not provide a desirable ball-launching effect. As such, it is also desirable to provide an improved lacrosse head that will allow a player to more effectively launch a ball, e.g., to throw a ball faster.

SUMMARY

In accordance with some embodiments, a lacrosse head frame includes a first frame portion comprising a top portion and two side walls, and a second frame portion, at least a portion of the second frame portion is moveable relative to the first frame.

In accordance with other embodiments, a lacrosse head frame includes a first frame portion comprising a proximal end, and a second frame portion having a distal end and a proximal end, wherein the distal end extends from, or is connected to, the first frame, and a spring, wherein the proximal end of the second frame is coupled to the proximal end of the first frame via the spring.

Other aspects and features of the invention will be evident from reading the following description of the embodiments.

BRIEF DESCRIPTION OF THE DRAWINGS

The drawings illustrate the design and utility of embodiments, in which similar elements are referred to by common reference numerals. In order to better appreciate how advantages and objects of the embodiments are obtained, a more particular description of the embodiments will be illustrated in the accompanying drawings.

DETAILED DESCRIPTION OF THE EMBODIMENTS

Figure 1:
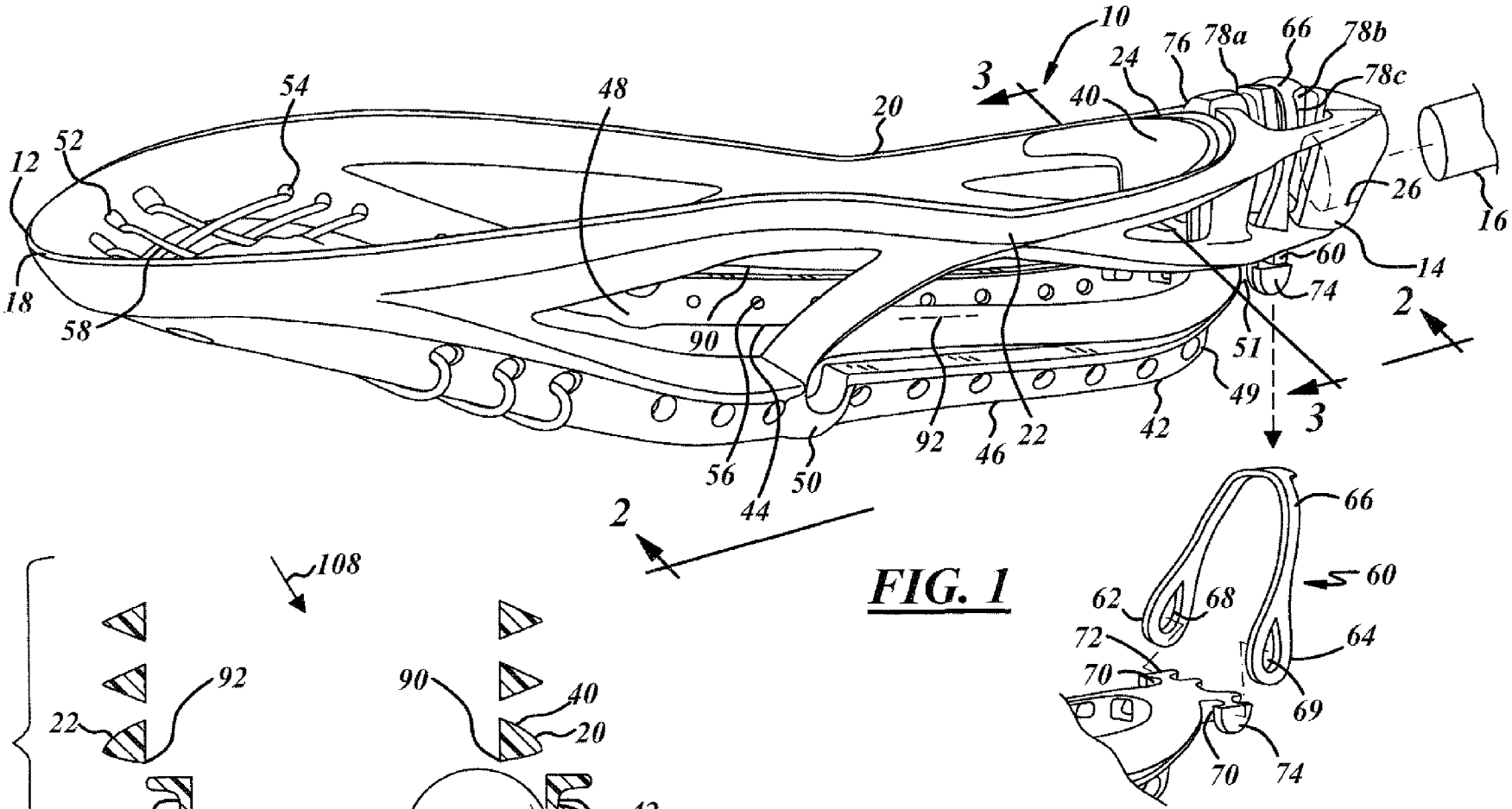
FIG. 1 illustrates an isometric view of a lacrosse head frame in accordance with some embodiments.

Various embodiments are described hereinafter with reference to the figures. It should be noted that the figures are not drawn to scale and elements of similar structures or functions are represented by like reference numerals throughout the figures. It should also be noted that the figures are only intended to facilitate the description of specific embodiments. They are not intended as an exhaustive description of the invention or as a limitation on the scope of the invention. In addition an aspect described in conjunction with a particular embodiment is not necessarily limited to that embodiment and can be practiced in any other embodiments.

FIG. 1 illustrates a lacrosse head frame 10 in accordance with some embodiments. The lacrosse head frame 10 has a distal end 12, and a proximal end 14 that is configured (e.g., sized and shaped) to be connected to a shaft 16 to thereby form a lacrosse stick. The head frame 10 includes a top portion (scoop) 18 at the distal end 12, side walls 20, 22, a bottom portion (ball stop) 24, which are integrally formed together (e.g., by a traditional molding technique). In the illustrated embodiments, the head frame 12 also includes a socket 26 at the proximal end 14, which allows the shaft 16 to be fitted therein. It should be noted that the head frame 10 should not be limited to the shape and configuration illustrated in the figure, and that the head frame 10 can have other shapes and configurations in other embodiments. For example, in other embodiments, the head frame 10 can further include a pocket member that is secured to the top portion 18 of the head frame 10. Lacrosse heads having pocket members have been described in U.S. Pat. No. 6,506,132. Also, in other embodiments, the head frame 10 can further include one or more inserts (not shown) that are secured to the perimeter of the head frame 10.

In the illustrated embodiments, the top portion 18, the side walls 20, 22, and the bottom portion 24 form a first frame portion 40 of the head frame 10. The head frame 10 also includes a second frame portion 42 having a first side 44, a second side 46 extends from the first side 44, and an arm or extension 51 located at a proximal end 49 of the second frame portion 42. The first side 44 of the second frame portion 42 is secured to the first frame portion 40 at a first location 48, and the second side 46 of the second frame portion 42 is secured to the first frame portion 40 at a second location 50. In some embodiments, the sides 44, 46 may be fixedly secured to the first frame portion 40 via a glue or an, adhesive. In other embodiments, the sides 44, 46 may be fixedly secured to the first frame portion 40 by being integrally formed with the first frame portion 40. In further embodiments, the sides 44, 46 may be rotatably secured to the first frame portion 40. For example, the first side 44 may be rotatably secured to the first frame portion 40 at the first location 48 via a first shaft (not shown), and the second side 46 may be rotatably secured to the first frame portion 40 at the second location 50 via a second shaft (not shown). In any of the examples described, the second frame portion 42 is considered as being "coupled" to the first frame portion 40. The first and the second frame portions 40, 42 may be made from a variety of materials, such as a polymer or a carbon-fiber.

The lacrosse head frame 10 also includes a plurality of slots/holes 52 at the top portion 18, a plurality of slots/holes 54 along a portion of each of the side walls 20, 22, and a plurality of slots/holes 56 at the second frame portion 42. The slots/holes 52, 54, 46 are configured for allowing a net 58 (a portion of which is shown) to be attached to the head frame 10. For example, one or more strings passing through the slots/holes 52, 54, 46 may be used to connect the net 58 to the lacrosse head frame 10.

As shown in FIG. 1, the lacrosse head frame 10 also includes a spring 60 that is coupled between the first and the second frame portions 40, 42. In the illustrated embodiments, the spring 60 is an elastic band made from a polymer. The elastic band 60 has a first end 62, a second end 64, and a body 66 extending between the ends 62, 64. The elastic band 60 also includes a first loop opening 68 at the first end 62, and a second loop opening 69 at the second end 64. The elastic band 60 is anchored to the second frame portion 42 by placing the loop openings 68, 69 within grooves 70 around protrusions 72, 74 at opposite sides of the arm/extension 51. The elastic band 60 is also anchored to the first frame portion 40 by looping the body 66 around an anchor portion 76 at the proximal end 14 of the first frame portion 40. The anchor portion 76 has a plurality of slots 78*a*-78*c*, each of which can be selectively used to anchor the elastic band 60 (e.g., by placing the body 66 in one of the slots 78). The distance between the 6 slots 78 (anchor points) and the protrusion 72/74 are different, thereby allowing a tension in the elastic band 60 to be selected by placing the elastic band 60 on a selected one of the slots 78. In other embodiments, instead of three slots 78, the anchor portion 76 can have more or less than three slots 78. It should be noted that the spring 60 is not limited to the configuration shown, and that the spring 60 can have other configurations in other embodiments. For example, in other embodiments, the spring 60 can be a metallic coil having a first end secured to the first frame portion 40, and a second end secured to the second frame portion 42. In such cases, the head frame 10 does not include the grooves 70. Instead, the head frame 10 may include a hook or a loop for allowing the first end of the coil to be anchored.

In other embodiments, instead of, or in addition to, having slots 78 at the first frame portion 40, the lacrosse head frame 10 may have one or more slots (not shown) at the second frame portion 42. In such cases, the spring 60 may have a form of a loop, with one end of the loop being anchored to the first frame portion 40, and the other end of the loop being anchored to one of the slot(s) at the second frame portion 42.

Figure 2:
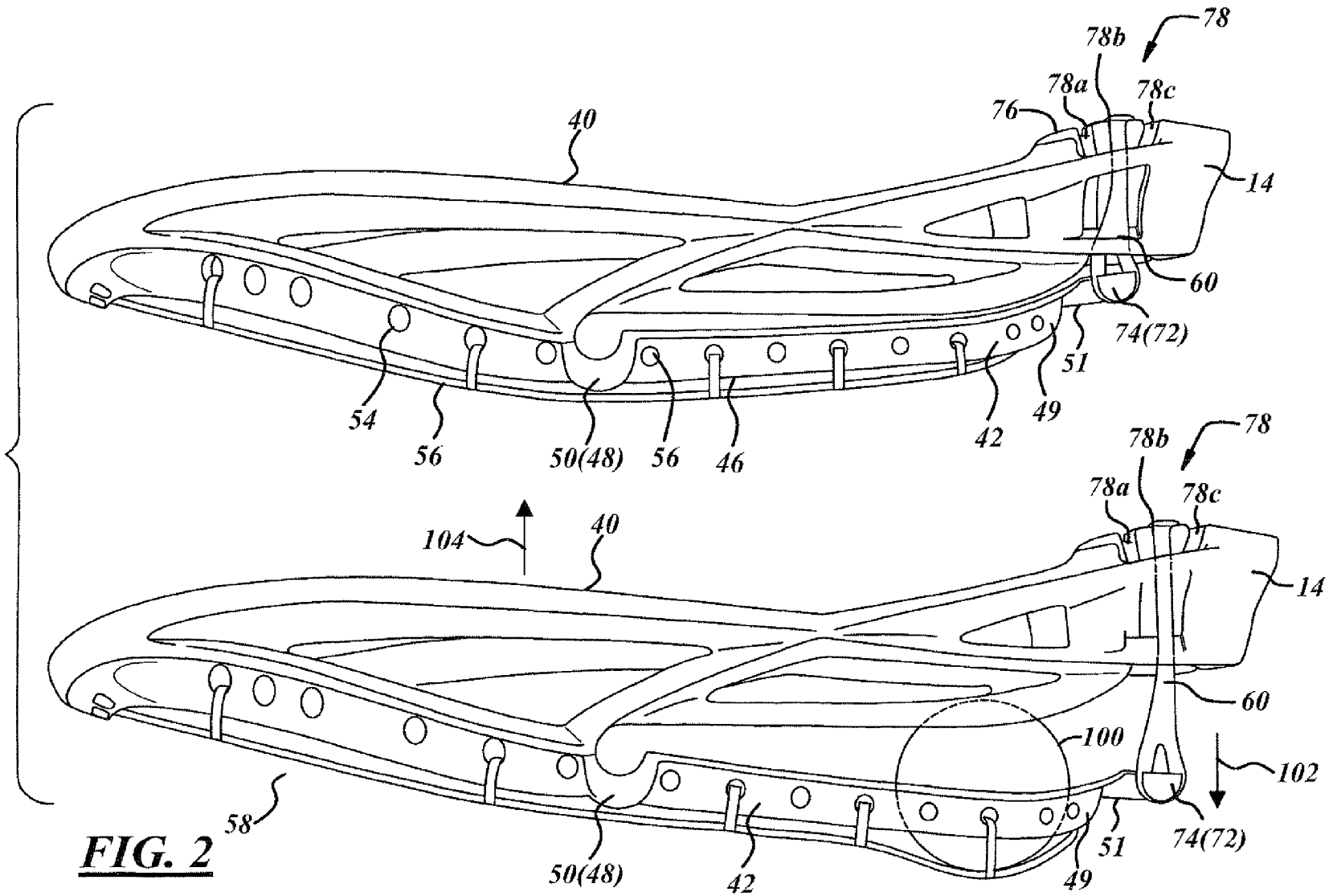
FIG. 2 illustrates a side view of the lacrosse head frame of FIG. 1 in accordance with some embodiments.

FIG. 2 illustrates a side view of the lacrosse head frame 10 in accordance with some embodiments. During use, as the head frame 10 catches a ball 100, the proximal end 49 of the second frame portion 42 moves relative to the first frame portion 40 in the direction 102 (the transverse direction), thereby providing a damping effect. As a result, a player will feel more comfortable when 7 catching the ball 100. Also, as the head frame 10 is used to throw or launch the ball 100, due to the weight of the ball 100 and the momentum of the head frame 10 moving in the direction 104, the second frame portion 42 will also move relative to the first frame portion 40 in the direction 102. As the ball 100 is being launched, the spring 60 will pull the second frame portion 42 back towards the first frame 40, thereby enhancing the launching effect (e.g., providing a faster launching speed) on the ball 100.

In the illustrated embodiments, the second frame portion 42 extends from, or is secured via an adhesive to, the first frame portion 40 at locations 48, 50. In such cases, movement (translation and/or rotation) of the proximal end 49 of the second frame portion 42 is accomplished by elastic deformation of the material at the locations 48, 50. In other embodiments, instead of, or in addition to, the elastic deformation of the material at the locations 48, 50, the movement of the proximal end 49 of the second frame portion 42 may be accomplished by elastic deformation of the second frame portion 42.

Figure 3:
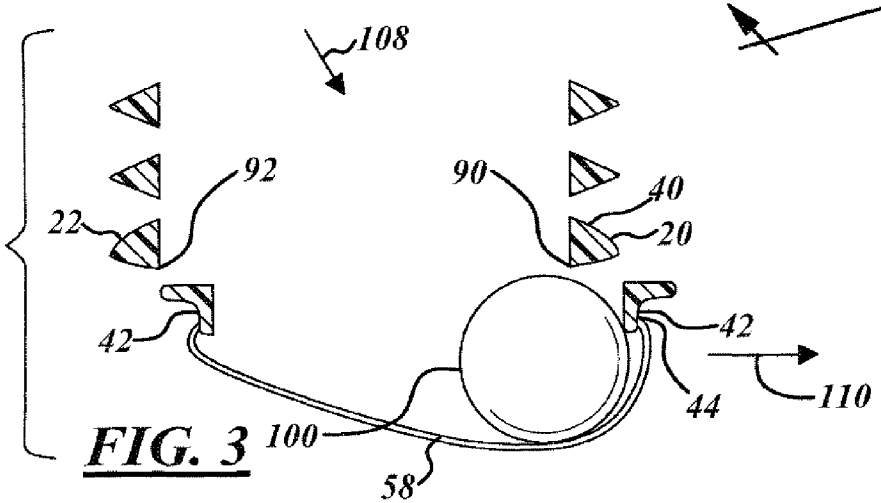
FIG. 3 illustrates an end view of the lacrosse head frame of FIG. 1 in accordance with some embodiments.

FIG. 3 illustrates an end view of the lacrosse head frame 10 in accordance with some embodiments. As shown in the figure, during use, the second frame portion 42 may slide laterally relative to the first frame portion 40 in the direction 110 (lateral direction). The sliding of the second frame portion 42 may be accomplished, at least in part, by flexing of the material at the locations 48, 50 and/or flexing of the first and second sides 44, 46 of the second frame portion 42. During use, the head frame 10 may be used to catch the ball 100 coming in from a direction 108. As the net 58 catches the ball 100, the momentum of the ball 100 causes the second frame portion 42 to move relative to the first frame portion 40 in the lateral direction 110. Such feature is desirable because it allows a ball to be more easily retained by either edges 90, 92 of the first frame portion 40 after it has caught the ball. In the illustrated example, the edge 90 of the first frame portion 40 helps keep the ball 100 in the pocket of the net 58.

Although particular embodiments have been shown and described, it will be understood that it is not intended to limit the present inventions, and it will be obvious to those skilled in the art that various changes and modifications may be made. The specification and drawings are, accordingly, to be regarded in an illustrative rather than restrictive sense.

What is claimed is:

1. A lacrosse head frame, comprising:

a first frame portion comprising a top portion and two side walls; and a second frame portion, at least a portion of the second frame portion is moveable relative to the first frame portion, wherein the first frame portion has a first proximal end, the second frame portion has a second proximal end, and the lacrosse head frame comprises a spring coupling to the first and the second proximal ends, wherein the spring comprises an elastic band, wherein the first frame portion comprises a plurality of slots, each of the slots sized to accommodate a body portion of the elastic band, thereby allowing the body portion of the elastic band to be selectively placed in one of the plurality of slots.

2. The lacrosse head frame of claim 1, wherein the first frame portion has a proximal end configured to be secured to a shaft, and the second frame portion is coupled to the first frame portion at a location that is distal to the proximal end of the first frame portion.

3. The lacrosse head frame of claim 1, wherein the second frame portion is integrally formed with the first frame portion.

4. The lacrosse head frame of claim 3, wherein the second frame portion is integrally connected to the first frame at one end of the second frame.

5. The lacrosse head frame of claim 3, wherein a proximal end of the second frame portion is rotatable relative to the first frame by elastic deformation of a material that forms a part of the second frame portion or the first frame portion.

6. The lacrosse head frame of claim 1, wherein the first frame portion has a first proximal end, the second frame portion has a second proximal end, and the lacrosse head frame further comprises a spring coupling to the first and the second proximal ends.

7. The lacrosse head frame of claim 6, wherein the spring comprises an elastic band.

8. The lacrosse head frame of claim 1, further comprising a net coupled to the first frame portion and the second frame portion.

9. The lacrosse head frame of claim 1, wherein the second frame portion has a U-shape.

10. The lacrosse head frame of claim 9, wherein one end of the U-shape second frame portion is coupled to one of the two side walls of the first frame portion, and another end of the U-shape second frame portion is coupled to another of the two side walls of the first frame portion.

11. The lacrosse head frame of claim 1, wherein the second frame portion has a protrusion for allowing a spring to be anchored thereto.

12. A lacrosse head frame, comprising:

a first frame portion comprising a top portion and two side walls; and a second frame portion, at least a portion of the second frame portion is moveable relative to the first frame portion, wherein the first frame portion has a first proximal end, the second frame portion has a second proximal end, and the lacrosse head frame comprises a spring coupling to the first and the second proximal ends, wherein the spring comprises an elastic band, wherein the second frame portion has a pair of protrusions for allowing said elastic band to be anchored thereto.

13. The lacrosse head frame of claim 12, wherein a loop opening at each end of said elastic band is coupled around a groove contained within a respective one of said pair of protrusions.

14. The lacrosse head frame of claim 1, wherein each of the first and the second frame portions is made from a polymer.

15. A lacrosse head frame, comprising:

a first frame portion including a top portion having a scoop, the first frame portion including a bottom portion adjacent a first frame portion proximal end that defines a socket configured to join with a lacrosse shaft, the first frame portion including first and second side walls joining the top portion and the bottom portion; and a second frame portion including first and second sides positioned adjacent the first and second side walls, the first and second sides being joined with the first frame portion at respective first and second locations, the second frame portion including a second frame portion proximal end adjacent the first frame portion proximal end, wherein the second frame portion moves away from the first frame portion as a player catches a ball to provide a dampening effect;

wherein the second frame portion moves toward the first frame portion as the player shoots the ball to provide an enhanced launching effect;

wherein the lacrosse head frame comprises a spring coupling to the first frame portion proximal end and to the second frame portion proximal end:

wherein the spring comprises an elastic band, wherein at least one of the first frame portion and second frame portion includes a slot, the slot sized to accommodate a body portion of the elastic band, thereby allowing the body portion of the elastic band to be selectively placed in the slot, wherein at least one of the first frame portion and second frame portion has a pair of protrusions for allowing said elastic band to be anchored thereto.

* * * * *